US007080773B1

(12) United States Patent
Tepley

(10) Patent No.: US 7,080,773 B1
(45) Date of Patent: Jul. 25, 2006

(54) MAILBOX SNOWPLOW BLOCKING METHOD AND APPARATUS

(76) Inventor: Edward J. Tepley, 17219 Mayfield Rd., Apartment E, Windsor, OH (US) 44099

( * ) Notice: Subject to any disclaimer, the term of this patent is extended or adjusted under 35 U.S.C. 154(b) by 0 days.

(21) Appl. No.: 11/107,092

(22) Filed: Apr. 18, 2005

(51) Int. Cl.
*A47G 29/12* (2006.01)

(52) U.S. Cl. ..... 232/17; 232/39; 404/6

(58) Field of Classification Search ..... 232/39, 232/38, 17; 404/6; D99/32; 40/606.06
See application file for complete search history.

(56) References Cited

U.S. PATENT DOCUMENTS

D204,049 S 3/1966 Hardy
3,672,638 A 6/1972 Krobs
4,187,978 A 2/1980 Dowker
4,932,634 A 6/1990 Sura
5,184,800 A 2/1993 Tabler
5,460,326 A 10/1995 Albanesius
6,824,113 B1 * 11/2004 Gee et al. ..... 248/218.4
6,962,460 B1 * 11/2005 Pratt ..... 404/6

* cited by examiner

*Primary Examiner*—William L. Miller

(57) ABSTRACT

A mailbox snowplow blocking method and apparatus includes a mailbox assembly with at least one mailbox and a vertical support that is attached to the mailbox and extends into a ground surface. A panel has a front side and a back side. Each of a pair of posts is attached to the back side of the panel and extend downwardly from the panel. A pair of sleeves, each with an upper end having an aperture extending therein, is extended into the ground surface adjacent to the mailbox assembly. Each of the posts has a bottom end that is extended into one of the sleeves. The sleeves are positioned so that the back side of the panel is adjacent to and aligned parallel with a lateral side wall of the mailbox assembly and the front side of the panel faces toward oncoming traffic.

5 Claims, 6 Drawing Sheets

MAILBOX SNOWPLOW BLOCKING METHOD AND APPARATUS

BACKGROUND OF THE INVENTION

1. Field of the Invention

The present invention relates to snow blocking devices and more particularly pertains to a new snow blocking device for preventing a mailbox adjacent to a street from becoming buried by a snowplow or by knocked over by a snowplow when the snowplow is plowing snow on the street adjacent to the mailbox.

2. Description of the Prior Art

The use of snow blocking devices is known in the prior art. U.S. Pat. No. 4,932,634 includes a fence assembly adapted for blocking snow along a roadway and the like. Another type of snow blocking device is U.S. Pat. No. 5,184,800 which includes a portable fence assembly adapted for blocking snow. Yet another snow fence design is found in U.S. Pat. No. 3,672,638.

While these devices fulfill their respective, particular objectives and requirements, the need remains for a device for aiding in the prevention of a mailbox being struck by a snowplow and being knocked over by the snowplow. The device will also prevent snow from being built up around a mailbox which may also lead to the mailbox being knocked over.

SUMMARY OF THE INVENTION

The present invention meets the needs presented above by generally comprising a mailbox assembly including at least one mailbox and a vertical support attached to the mailbox. The vertical support extends into a ground surface. A panel has a front side, a back side, a top edge, a bottom edge, a first side edge and a second side edge. Each of a pair of posts has a bottom end and a top end. Each of the posts is attached to the back side of the panel so that the top ends are positioned adjacent to the top edge and the bottom ends each extend downwardly from the panel. A pair of sleeves is provided. Each of the sleeves has an upper end having an aperture extending therein. The apertures each have a size adapted for removably receiving the bottom ends of the posts. Each of the sleeves is extended into the ground surface adjacent to the mailbox assembly. Each of the bottom ends is extended into one of the sleeves. The sleeves are positioned so that the back side of the panel is adjacent to and aligned parallel with a lateral side wall of the mailbox assembly and the front side of the panel faces toward oncoming traffic.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
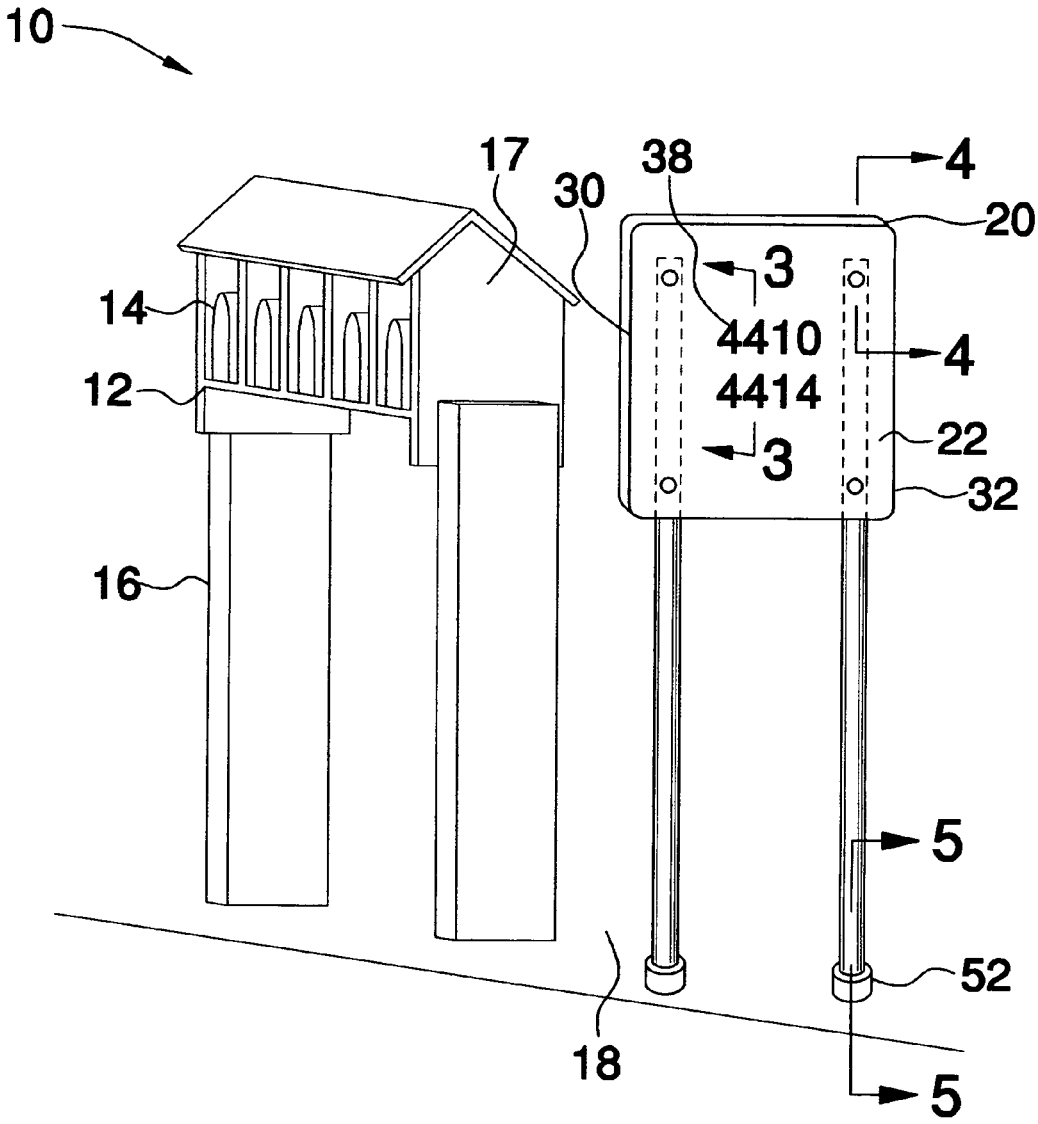
FIG. 1 is a perspective view of a mailbox snowplow blocking method and apparatus according to the present invention.
Figure 2:
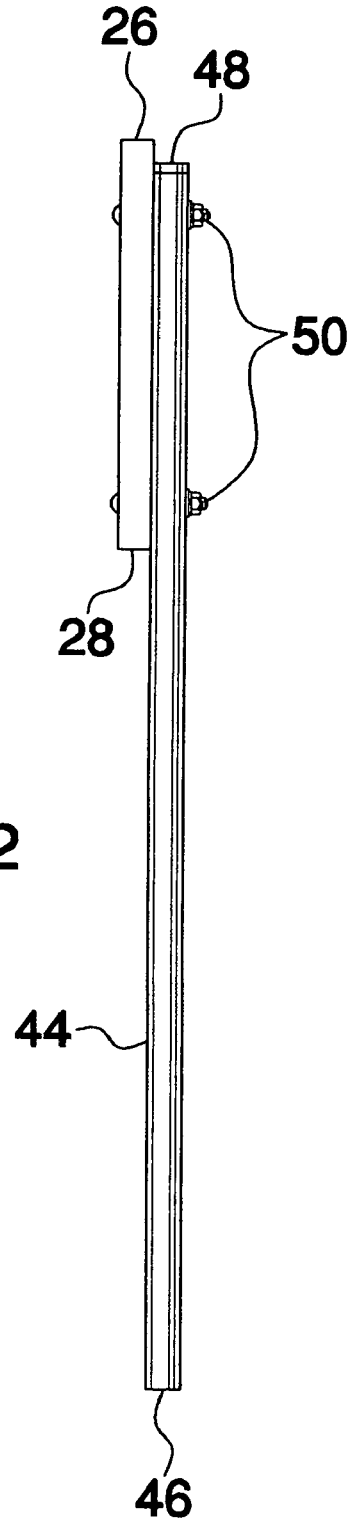
FIG. 2 is a side view of the present invention.
Figure 4:
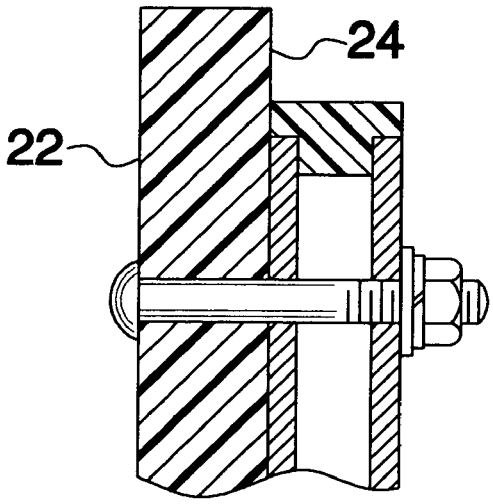
FIG. 4 is a cross-sectional view taken along line 4—4 of FIG. 1 of the present invention.
Figure 3:
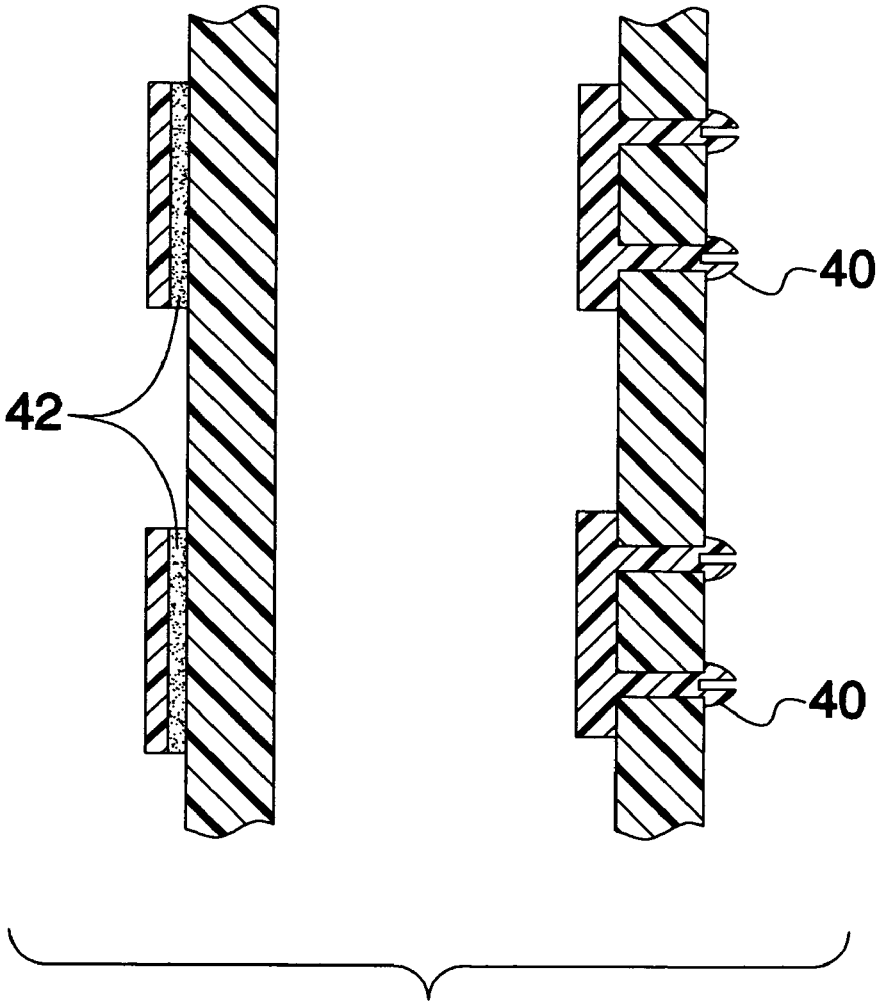
FIG. 3 is a cross-sectional view taken along line 3—3 of two methods of attaching indicia to the panel of the present invention.
Figure 5:
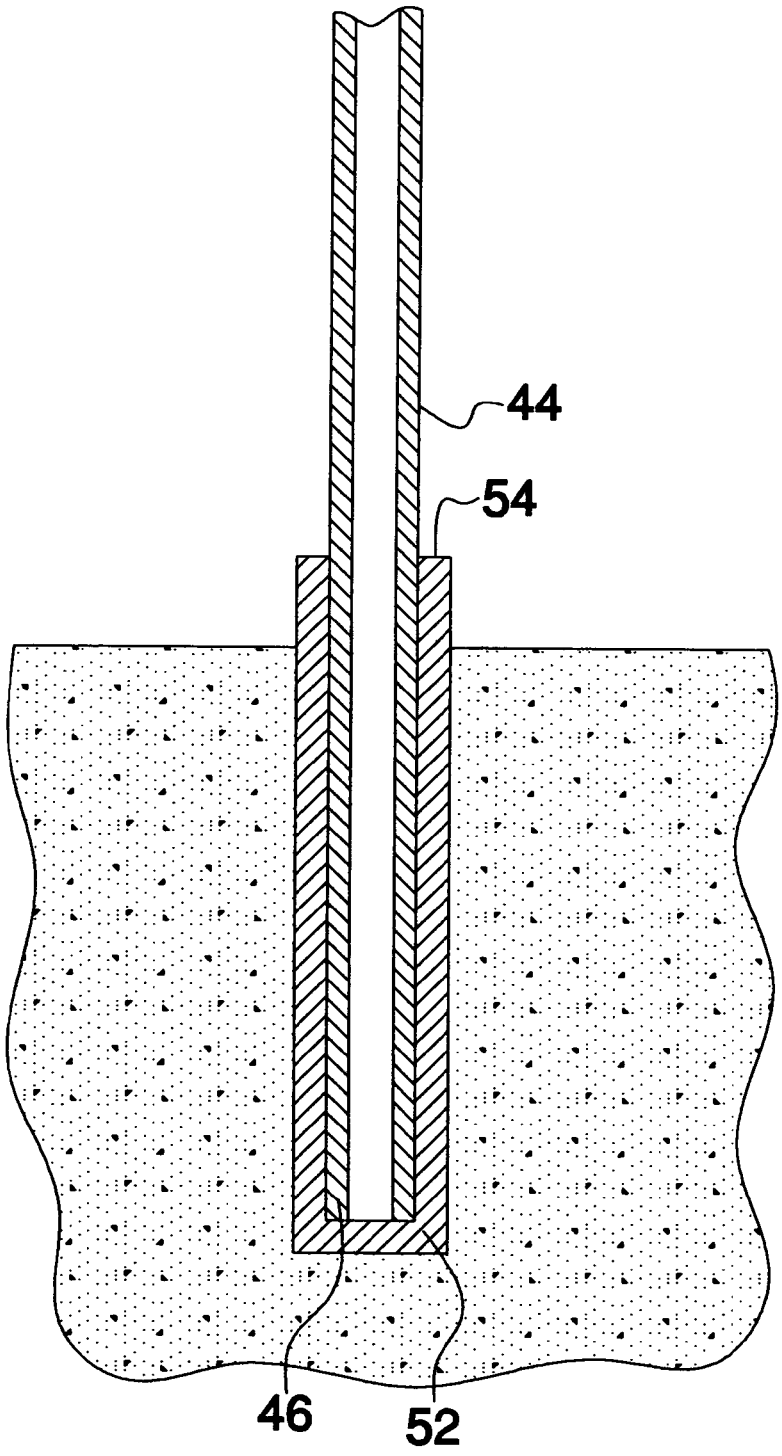
FIG. 5 is a cross-sectional view taken along line 5—5 of FIG. 1 of the present invention.

With reference now to the drawings, and in particular to FIGS. 1 through 8 thereof, a new snow blocking device embodying the principles and concepts of the present invention and generally designated by the reference numeral 10 will be described.

As best illustrated in FIGS. 1 through 8, the mailbox snowplow blocking method and apparatus 10 generally comprises providing a conventional mailbox assembly 12 that includes at least one mailbox 14 and a vertical support 16 attached to the mailbox 14. The vertical support 16 extends into a ground surface 18.

Figure 6:
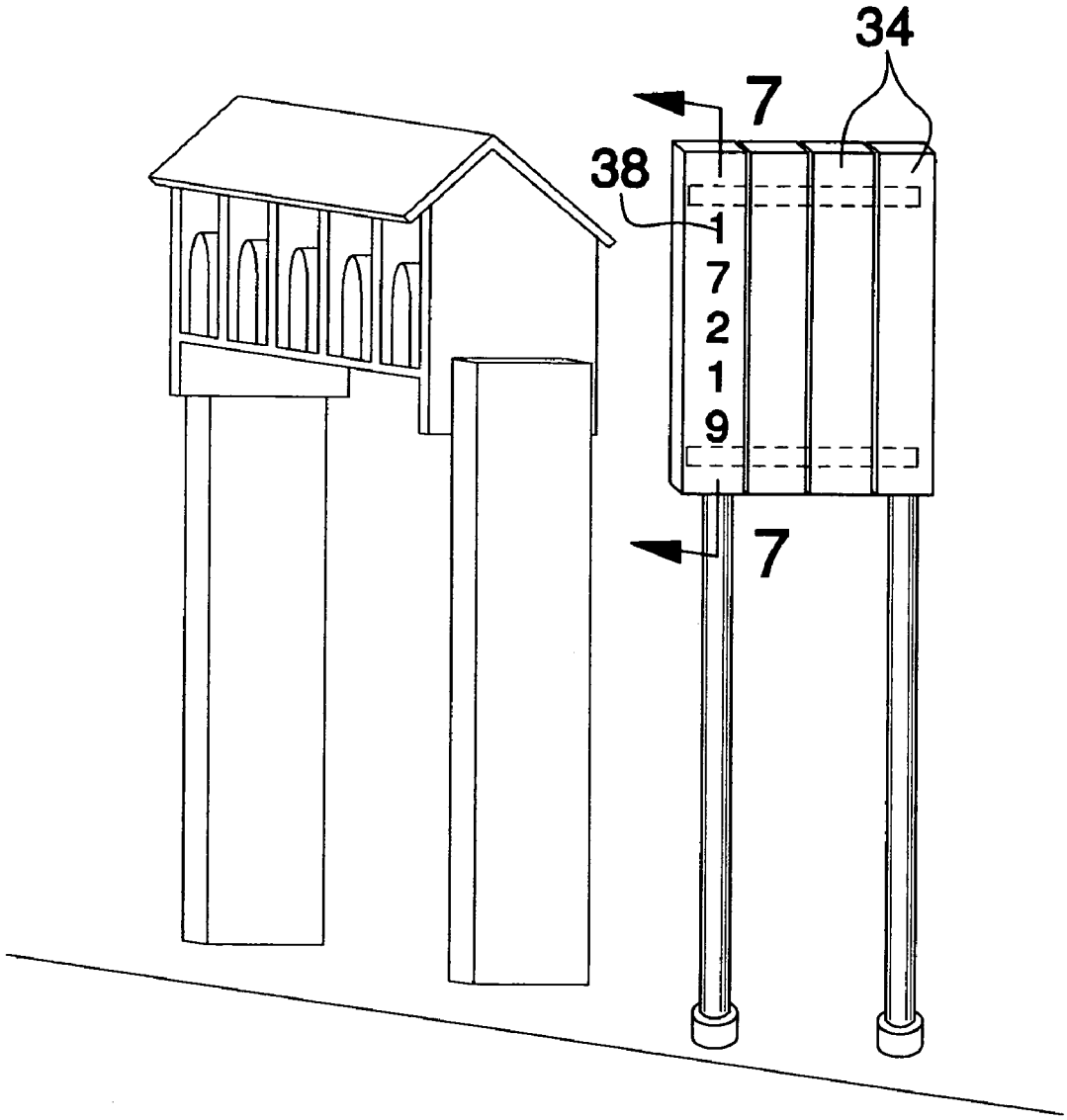
FIG. 6 is a perspective view of a second embodiment of the present invention.
Figure 8:
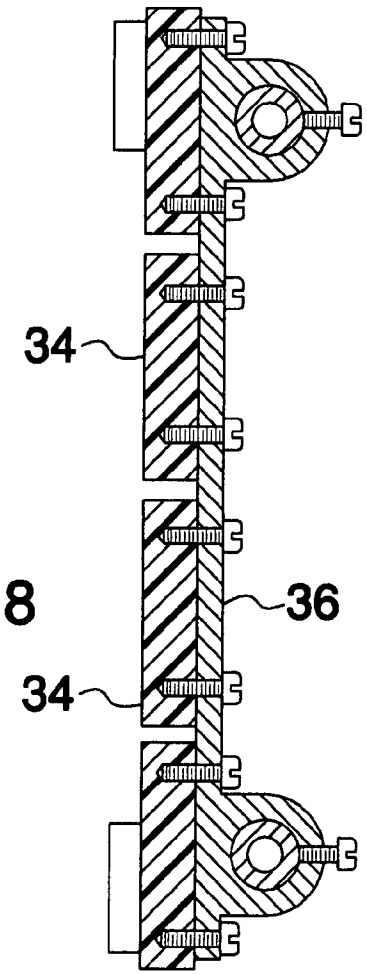
FIG. 8 is a cross-sectional view taken along line 8—8 of FIG. 7 of the present invention.
Figure 7:
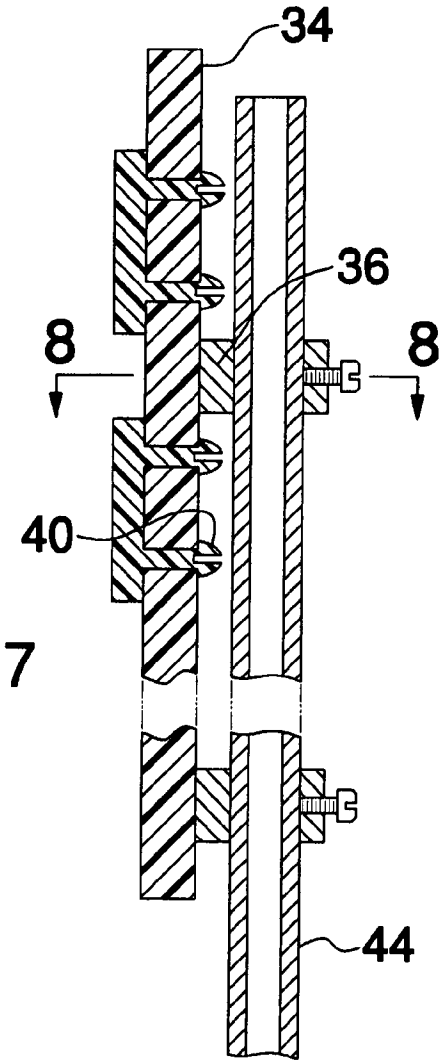
FIG. 7 is a cross-sectional view taken along line 7—7 of FIG. 6 of the present invention.

A panel 20 has a front side 22, a back side 24, a top edge 26, a bottom edge 28, a first side edge 30 and a second side edge 32. The panel 20 has a height from the bottom edge 28 to the top edge 26 equal to at least 18 inches but preferably no more than 36 inches. The panel 20 has a width from the first side edge 30 to the second side edge 32 equal to at least 24 inches and no more than 36 inches. It is preferred that the panel 20 has a size at least equal to about the size of a lateral side wall 17 of mailbox assembly 12. FIG. 1 depicts a solid panel 20 construction while FIG. 6 shows a panel 20 constructed of a plurality of slats 34 held together by horizontal member 36.

Address indicia 38 are positioned on the front side 22 of the panel 20. These may be snapped to the panel 20 with brackets 40 or secured to the panel with an adhesive 42. Alternatively the indicia 38 may be painted on the panel 20.

A pair of posts 44 is provided. Each of the posts 44 has a bottom end 46 and a top end 48. Each of the posts 44 is attached to the back side 24 of the panel 20 with fasteners 50 so that the top ends 48 are positioned adjacent to the top edge 26 and the bottom ends 46 each extend downwardly from the panel 20. Each of the posts 20 extends at least 60 inches downwardly from the panel 20.

A pair of sleeves 52 is provided. Each of the sleeves 52 has an upper end 54 having an aperture extending therein. The apertures each have a size adapted for removably receiving the bottom ends 46 of the posts 44. In use, each of sleeves 52 is extended into the ground surface 18 adjacent to the mailbox assembly 12. The bottom ends 46 of the posts 44 are then each extended into one of the sleeves 52. The sleeves 52 are positioned so that the back side 34 of the panel 20 is adjacent to and aligned parallel with the lateral side wall 17 of the mailbox assembly 12 and the front side 22 of the panel 20 faces toward oncoming traffic. When a snowplow travels toward and by the mailbox assembly 12, the panel 20 blocks the snow from accumulating around the mailbox assembly 12 so that the snow does not knock over the mailbox assembly. Additionally, the panel prevents a snowplow from itself knocking over the mailbox assembly 12 since a driver of the snowplow will see the panel 20 and will feel if snowplow striking the panel 20. The sleeves 52 allow for easy mounting and dismounting of the posts 44 so that the panel 20 may be taken down during non-snowing months.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of preventing a snowplow and snow moved by the snowplow from striking a mailbox, said method comprising the steps of:

providing a mailbox assembly including at least one mailbox housing and a vertical support attached to the mailbox housing, said vertical support extending into a ground surface;

providing a panel having a front side, a back side, a top edge, a bottom edge, a first side edge and a second side edge;

providing a pair of posts, each of said posts having a bottom end and a top end, each of said posts being fixedly and directly attached to said back side of said panel to prevent relative movement therebetween and such that said top ends are positioned adjacent to said top edge and said bottom ends each extend downwardly from said panel;

a pair of sleeves, each of said sleeves having an upper end having an aperture extending therein, said apertures having a size adapted for removably receiving said bottom ends of said posts;

extending each of said sleeves into said ground surface adjacent to said mailbox assembly; and extending each of said bottom ends into one of said sleeves, said sleeves being positioned such that said back side of said panel is adjacent to and aligned parallel with a lateral side wall of the mailbox assembly and said front side of said panel faces toward oncoming traffic.

2. The method according to claim 1, wherein said panel has a height from said bottom edge to said top edge equal to between 18 inches and 36 inches, said panel having a width from said first side edge to said second side edge equal to at least 24 inches.

3. The method according to claim 1, further providing address indicia being positioned on said front side.

4. The method according to claim 1, wherein each of said posts extends at least 60 inches downwardly from said panel.

5. A method of preventing a snowplow and snow moved by the snowplow from striking a mailbox, said method comprising the steps of:

providing a mailbox assembly including at least one mailbox housing and a vertical support attached to the mailbox housing, said vertical support extending into a ground surface;

providing a panel having a front side, a back side, a top edge, a bottom edge, a first side edge and a second side edge, said panel having a height from said bottom edge to said top edge equal to between 18 inches and 36 inches, said panel having a width from said first side edge to said second side edge equal to at least 24 inches;

providing address indicia being positioned on said front side;

providing a pair of posts, each of said posts having a bottom end and a top end, each of said posts being fixedly and directly attached to said back side of said panel to prevent relative movement therebetween and such that said top ends are positioned adjacent to said top edge and said bottom ends each extend downwardly from said panel, each of said posts extending at least 60 inches downwardly from said panel;

a pair of sleeves, each of said sleeves having an upper end having an aperture extending therein, said apertures having a size adapted for removably receiving said bottom ends of said posts;

extending each of said sleeves into said ground surface adjacent to said mailbox assembly; and extending each of said bottom ends into one of said sleeves, said sleeves being positioned such that said back side of said panel is adjacent to and aligned parallel with a lateral side wall of the mailbox assembly and said front side of said panel faces toward oncoming traffic.

* * * * *